US006619199B2

(12) United States Patent
Merz et al.

(10) Patent No.: US 6,619,199 B2
(45) Date of Patent: Sep. 16, 2003

(54) PRINTING MACHINE WITH TORQUE COMPENSATION

(75) Inventors: Michael Merz, Sandhausen (DE); Karl-Heinz Helmstädter, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/014,483

(22) Filed: Oct. 23, 2001

(65) Prior Publication Data

US 2002/0083853 A1 Jul. 4, 2002

(30) Foreign Application Priority Data

Oct. 23, 2000 (DE) ..... 100 52 474

(51) Int. Cl.[7] ..... B41F 5/02; B41F 13/008

(52) U.S. Cl. ..... 101/216; 101/183; 101/480

(58) Field of Search ..... 707/783, 216, 707/232; 74/409, 417, 581, 582; 101/480

(56) References Cited

U.S. PATENT DOCUMENTS

| | | | | |
|---|---|---|---|---|
| 3,422,757 A | * | 1/1969 | Grobman et al. | 101/232 |
| 4,236,448 A | * | 12/1980 | Wieland | 101/216 |
| 5,136,943 A | * | 8/1992 | Fischer et al. | 101/183 |
| 5,357,858 A | | 10/1994 | Guaraldi et al. | |
| 5,746,091 A | | 5/1998 | Schaede | |
| 5,794,529 A | | 8/1998 | Dawley et al. | |
| 6,000,694 A | | 12/1999 | Kruger et al. | |

FOREIGN PATENT DOCUMENTS

| | | |
|---|---|---|
| DE | 23 47 568 | 4/1975 |
| DE | 28 35 960 C2 | 8/1979 |
| DE | 41 01 823 C2 | 8/1991 |
| DE | 44 37 145 C2 | 5/1996 |
| DE | 196 16 755 C 2 | 11/1997 |
| DE | 197 15 026 A 1 | 11/1997 |
| EP | 0 613 775 B1 | 9/1994 |

* cited by examiner

*Primary Examiner*—Leslie J. Evanisko
*Assistant Examiner*—Leo T. Hinze
(74) *Attorney, Agent, or Firm*—Laurence A. Greenberg; Werner H. Stemer; Ralph E. Locher

(57) ABSTRACT

For invention enables torque-compensation of alternating interference-torques in a printing machine. The printing machine, in particular a sheet-fed printing press, has one or more processing stations with cylinders and drums and at least one gear train. The gear train is formed with multiple gear-wheels that drive the cylinders and drums. In a first configuration there is provided an elastic coupling between two equidirectionally rotating gear-wheels. In a second configuration there is provided an elastic crank on a gear-wheel. There is thus impressed onto gear wheel or gear wheels, an additional and variable torque, in addition to the driving-torque of the printing machine.

17 Claims, 5 Drawing Sheets

PRINTING MACHINE WITH TORQUE COMPENSATION

BACKGROUND OF THE INVENTION

Field of the Invention

The invention lies in the printing technology field. More specifically, the invention pertains to a printing machine, in particular a sheet-fed printing machine with multiple processing stations that particularly include cylinders and drums and with a gear train formed with gear-wheels, which propel the cylinders and drums operationally, as well as a printing machine, a sheet-fed printing machine in particular, with at least one processing station that includes cylinders and drums and with one gear train consisting of intermeshing gear-wheels that propel the cylinders and drums operationally.

In the processing stations of a printing machine, in particular of a sheet-fed printing machine, alternating interference-torques in the gear train ensue. They are caused by cam-drives that drive the gear train, such as for example for the propulsion of a swing-gripper for the delivery of a resting sheet to a first cylinder. Those interference-torques can lead to oscillations and tooth-flank-changes, which can lead to mechanical wear and tear and above all to print-technological problems, namely to a deterioration of the print-quality, such as doubling or "ghosting".

To avoid the above-mentioned problems, German patent application DE 23 47 568 A1 provides for a swing-gripper-impulse of a printing-unit that a hydraulic control-device is pivoted at a swing-gripper-shaft, which is controlled by the machine with a closed-loop-control-system, whereby a torque-compensation with the swing-gripper is supposed to ensue. This is complex not only in terms of control but also in mechanical terms, if there are supposed to be variable nominal-actual-value-specifications through mechanical governors with speed-alternations.

German patent DE 41 01 823 C2 describes a gear train for the attainment of a secure tooth engagement in a gear train. The gear train has a bracing-gear-wheel separately positioned in the frame between two equidirectional turning gear-wheels, the position of which is adjustable in a positive manner.

Furthermore, U.S. Pat. No. 5,357,858 (European patent No. EP 613 775 B1) discloses a device, which touches two gear-wheels of a gear train that are combing together with each other. A first gear-wheel together with the propelling gear-wheel of the gear train is provided, where a second gear-wheel combs with the propelling gear-wheel of the gear train and where, coaxial to the first gear-wheel, a third gear-wheel is provided, that combs together with the second gear-wheel, and which is pre-stressed relative to the first gear-wheel. Such a configuration is very complex in mechanical terms.

Finally, U.S. Pat. No. 6,000,694 (German patent application DE 196 16 755) describes a drive system for an oscillating swing-gripper of a sheet-fed printing machine. There, a separate drive is provided for avoiding the above-mentioned torque-changes during normal operation. Due to safety reasons, for the case of a cessation of the additional controlled drive, there is provided a mechanical coupling of the swing-gripper together with the main-drive-phase-belt, though not effective during normal operation and which can also thereby not cause a torque-alternation in the main-drive-phase-belt. This solution too is complex and in particular relatively expensive.

SUMMARY OF THE INVENTION

It is accordingly an object of the invention to provide a printing machine which overcomes the above-mentioned disadvantages of the heretofore-known devices and methods of this general type and which counteracts the influences of the appearing interference-torques of a gear train consisting of gear-wheels, which mesh with each other and to do that with simple and economical means.

With the foregoing and other objects in view there is provided, in accordance with the invention, a printing machine, in particular a sheet-fed printing machine, comprising:

a plurality of rollers and drums;

a gear train formed with a plurality of mutually meshing gear-wheels connected to and driving the cylinders and drums;

the gear-wheels of the gear train including first and second equidirectionally rotating gear-wheels each having a respective coupling position defined thereon; and an elastic coupling articulated at the coupling positions, the elastic coupling transferring a periodically changing torque from the first gear-wheel to the second gear-wheel.

In accordance with an added feature of the invention, the coupling positions are defined in phase and at radially even positions of the first and second gear-wheels; or the coupling positions are defined out of phase and at radially even position of the first and second gear-wheels; or the coupling positions are defined in phase and at radially uneven positions of the first and second gear-wheels; or the coupling positions are defined out of phase and at radially uneven positions of the first and second gear-wheels.

In accordance with an additional feature of the invention, the elastic coupling is a resilient, i.e., springy, and absorbing coupling.

In accordance with another feature of the invention, the elastic coupling includes an elastomer part. In particular, the coupling may include a resilient and absorbing polymer.

In a particularly preferred embodiment, the elastic coupling includes a spring. Specifically, the elastic coupling may comprise a cylindrical housing and a coupling rod having an abutment-board guided within the cylindrical housing, and springs disposed between the cylindrical housing and the abutment-board.

In accordance with a further feature of the invention, the elastic coupling comprises a rigid coupling rod and a leaf spring connected to the rigid coupling rod. Further, the rigid coupling rod may be one of two rigid coupling sections connected by the leaf spring.

In accordance with again an added feature of the invention, there is provided a second elastic coupling connected between the first and second gear-wheels, the second elastic coupling operationally transferring a periodically changing torque from one to the other of the first and second gear-wheels. In accordance with a concomitant feature of the invention, the first and second couplings are disposed opposite one another and out of phase relative to one another.

With the above and other objects in view there is provided, in accordance with the invention, a printing machine, in particular a sheet-fed printing press, comprising:

at least one processing station including cylinders and drums;

at least one gear train formed with a plurality of mutually intermeshing gear-wheels connected to and driving the cylinders and drums; and a crank assigned to one of the gear-wheels and configured to impress thereon a periodically changing torque.

In other words, the objects of the invention are achieved with a printing machine, of the type mentioned in the introductory text, in that a respective coupling position is assigned to the two equidirectional turning gear-wheels of the gear train and that an elastic coupling is provided at the coupling positions, which operationally transfers a torque periodically changing from one to the other of the two gear-wheels.

In a printing machine, in particular in a sheet-fed printing machine, with at least one processing station including the cylinders and drums, and with one gear train out of gear-wheels that mesh with each other and which operationally propel the cylinders and drums, it is provided in an alternative configuration, for a stationary pivoted elastic crank to be assigned to one of the gear-wheels, which impresses operationally a torque onto the gear-wheel that is periodically changing.

The instant invention thus proposes a purely mechanical solution without any electrical control or regulation and with a small number of parts.

Other features which are considered as characteristic for the invention are set forth in the appended claims.

Although the invention is illustrated and described herein as embodied in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
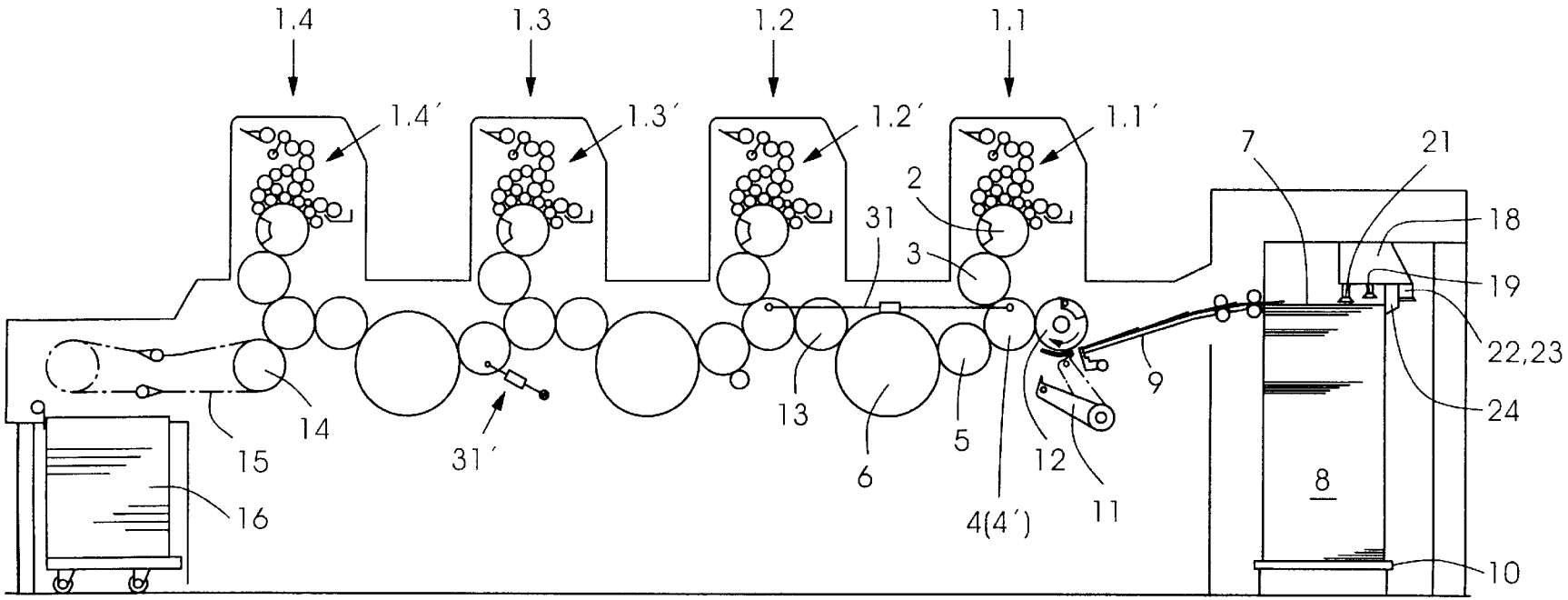
FIG. 1 is a schematic side view of a sheet-fed printing machine.

Referring now to the figures of the drawing in detail and first, particularly, to FIG. 1 thereof, there is shown a rotary print press that processes sheets 7. The machine includes a feeder, processing stations, in particular in form of printing unit units 1.1 through 1.4, and a delivery. The sheets are extracted from a stack of sheets 8 and are fed scaled via a feeding-table 9 to the first printing unit 1.1.

The stack of sheets 8 rests on a controlled feed-plate 10 that can be lifted. The extraction of the sheets 7 is effected from the top of the stack of sheets 8 by means of a suction-head 18, which shows among others also a number of lifting- and forwarding suckers 19, 21 for the separation of the sheets. Additionally blowing-devices 22 for loosening the top layers and touching-elements 23 for the stack tracking are provided. For the alignment of the stack of sheets, in particular of the top sheet 7 of the stack of sheets 8, there are provided a number of lateral and back lays 24.

The top sheet 7 of the stack of sheets 8 is lifted by lifting suckers 19 and is handed over to the forwarding suckers 21, which feed the sheet 7 to the feeding-table 9. At the end of the feeding-table 9 that is averted from the feeder there is disposed an oscillating swing-gripper 11, which takes the sheet 7 from the feeding-table 9 and hands it over to a feed-drum 12 that is furnished with gripper systems. Sequentially arranged sheet-processing printing units 1.1 to 1.4 are following that feed-drum 12; the printing units 1.1 to 1.4 work exemplary according to the offset-process and which accomplish the transfer of the sheets to a respectively subsequent printing unit by means of cylinders and drums that are furnished with gripper systems.

The printing units 1.1 to 1.4 each include an inking-unit 1.1' to 1.4', and in the case of an operation in the wet-offset-printing-process, a damping-unit, a printing-unit-cylinder in form of a plate-cylinder 2, a blanket-cylinder 3 and an impression cylinder 4. Between a preceding one of the printing units 1.1 to 1.4 and a subsequent one, a first transfer roller 5, which takes the sheets over from a printing cylinder 4 of the preceding printing unit, a storage drum 6, which takes the sheets over from the first transfer roller 5, and a second transfer roller 13, which takes the sheets over from the storage drum 6, are arranged in that way, that they hand over the respective sheet to the printing cylinder 4 of the subsequent printing unit. It is thereby preferred that at least one sheet transfer device, formed by the first and second transfer roller 5 and 13, and the storage drum 6, is configured such that it can be switched from a first into a second operating-condition and from a second into a first operating-condition. The second transfer roller 13 hands over a respective sheet in a first operating-mode with the leading edge of the sheet leading and in the second operating-mode with trailing-edge of the sheet leading and turned to the following printing-cylinder 4.

A delivery roller 14 follows the printing-cylinder 4 of the last printing unit—in the present example of printing unit 1.4—which drives a circulatory gripper system 15, that delivers the sheets from the rotary printing press. The sheets which had been handed over from the feed-drum 12 to the printing-cylinder 4 of the first printing unit 1.1, are laid down onto a delivery stack 16.

An interconnected gearbox is provided for driving the printing-unit-cylinder, the drums of the sheet-transfer-devices, the part of the inking-unit- and damping-unit-rollers that is not propelled via friction, the delivery roller, the feed-drum and the swing-gripper. The interconnected gearbox is, in the present exemplary embodiment, in essence formed by gear-wheels that mesh with each other. It is possible to provide chain drives for driving the guide rollers of the gripper system 15 by the delivery roller 14 and the separation-device by the feed-drum.

The gear-wheels that mesh with each other are respectively shown as a gear-wheel that is assigned to the respective cylinder, or to the respective drum, whereby there is a fixed connection between a respective cylinder or a respective drum, respectively on the one hand and those assigned gear-wheels on the other hand, so that a respective gear-wheel of the gear-wheels is shown in FIG. 1 in the same manner as the respective cylinder or the respective drum.

The entirety of the gear-wheels forms a coherent gear train with a main-strand, which extends over all printing units, and with lateral-strands that branch off the respective one gear-wheel, which propels the printing-cylinder 4, and respective printing unit cylinders in form of the blanket-cylinders 3 and of the plate-cylinder 2, as well as inking-unit-rollers of the inking-units 1.1' to 1.4', and that, in the present case, also drive damping-unit-rollers. The printing unit 1.2 can for example form a so-called driving-printing unit, e.g. the feed of the driving-power with a driving-torque for the operation of the rotary-press ensues then via a gear-wheel that belongs to the printing unit 1.2, here for example via that one gear-wheel, which is connected with the first transfer roller 5 of the sheet-transport-device, which follows the printing unit 1.2.

At the gear-wheel of the transfer roller 5 thus ensues a branching off of a power-flux, that is fed-in into the rotary-press via this gear-wheel, into a part, which flows into the direction of the delivery printing unit 1.4, and into a part, which flows via the printing unit 1.1 and that finally supplies the swing-gripper. The gear-wheel of the transfer roller 5 of the printing unit 1.2, which branches off the power-flux, thus forms a driving-wheel, which is a component of the mentioned gear train, which—as can be seen in FIG. 1—is formed out of the entirety of the mutually meshing gear-wheels.

Usually the movement of the oscillating swing-gripper is impressed onto it via a cam-gear train that is driven by the gear train. This creates alternating torques in the gear train. For the compensation of the torques, the invention provides an elastic coupling 31 between two parallel-running gear-wheels of the gear train. The coupling in the illustrated example is pivoted at gear-wheels assigned to the printing-cylinders 4 of the printing units 1.1 and 1.2.

Figure 2:
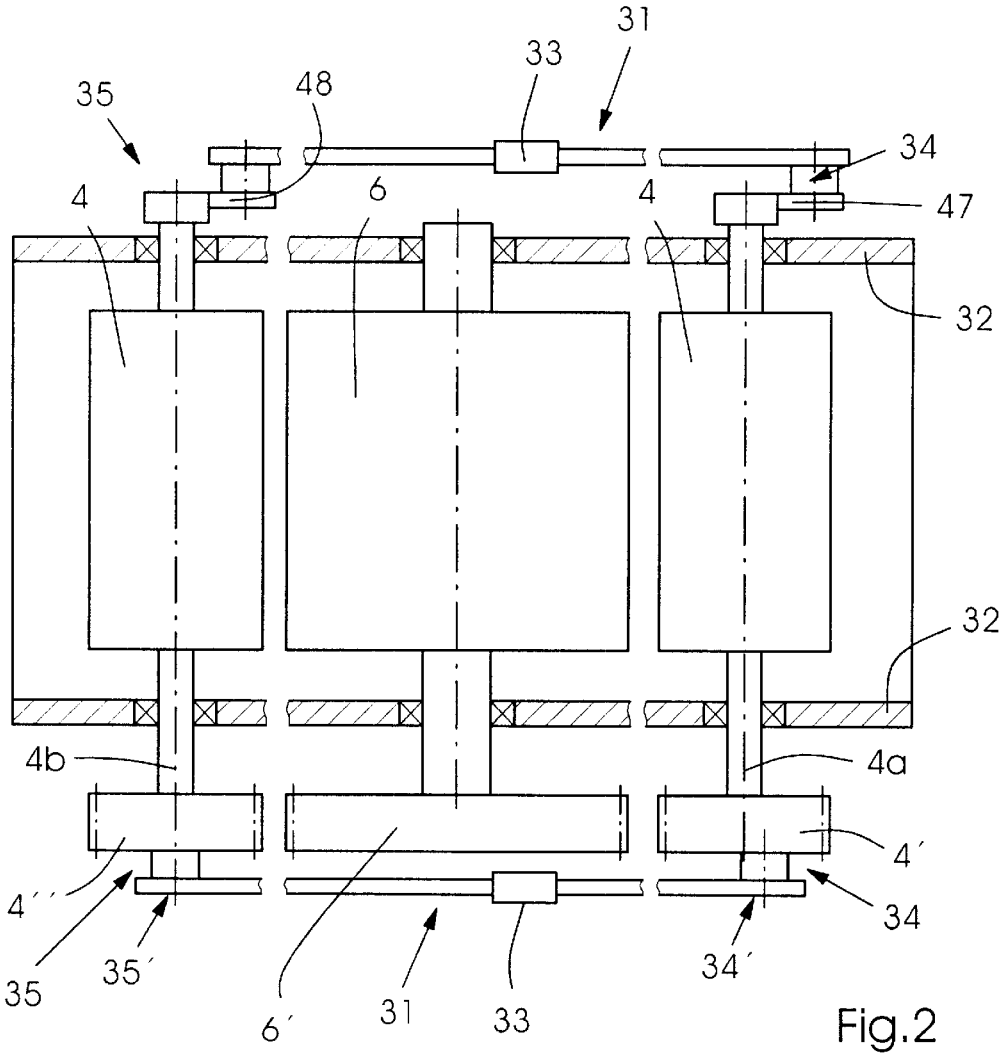
FIG. 2 is a partial plan-view and sectional view of a portion of the printing machine of FIG. 1.

This portrayed in more detail in FIG. 2. Both the respective printing-cylinders of the printing units 1.1 and 1.2 are marked with the numeral 4, while the numeral 6 marks the storage drum between the two. The transfer rollers 5, 13 that are planned for each printing-cylinder, and the gear-wheels that are assigned to those are not illustrated.

Gear-wheels 4' and 4" are rigidly connected with the printing-cylinders 4. A gear-wheel 6' is rigidly connected with the transfer roller 6. The frame of the printing machine is identified with numeral 32.

The two gear-wheels 4' and 4" of the printing cylinder 4 turn equidirectionally. In this respect, a coupling position 34, 35 is assigned to each of these gear-wheels, to which pivot-members 34', 35' of an elastic coupling 31 are articulated. A graphically emphasized section 33 of the coupling 31 symbolizes its elasticity that can be implemented in several different ways.

The coupling positions 34, 35 are arranged, depending on whatever configuration is preferred, in phase and radially even, radially even and out of phase, radially uneven and in phase, or radially uneven and out of phase, with reference to the two gear-wheels.

Figure 3A:
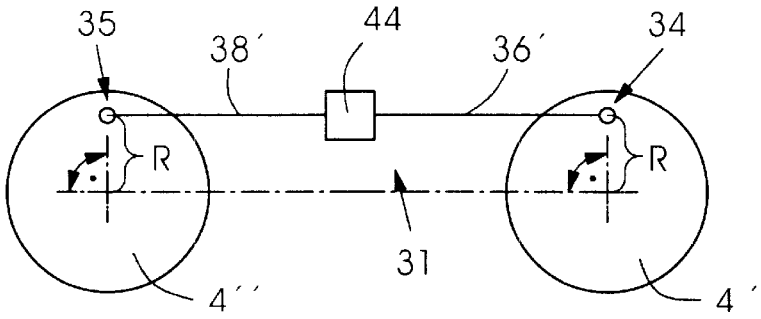
FIGS. 3*a*–3*d* are diagrammatic side views of alternatives of the assignment of a coupling configured according to the invention, towards equidirectional turning gear-wheels with respectively different positions of the coupling positions.
Figure 3B:
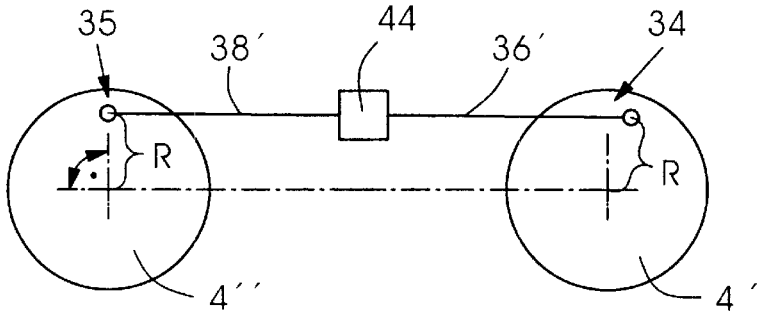
Figure 3C:
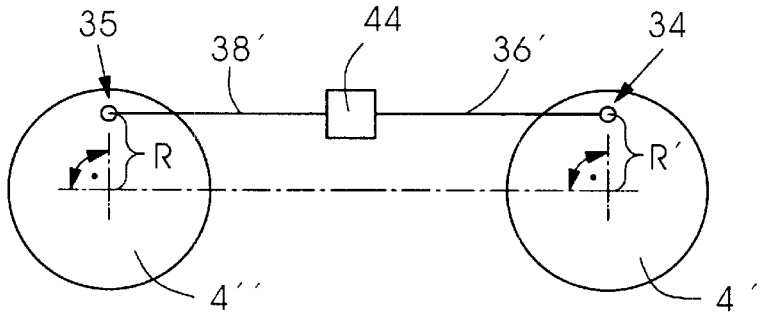
Figure 3D:
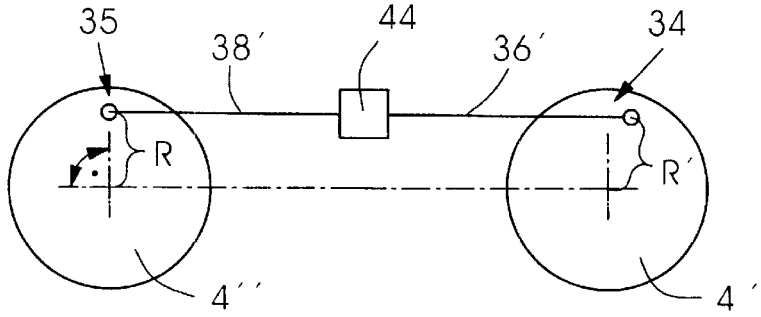

In the configuration illustrated in FIGS. 3*a* through 3*d*, the coupling-sections 36', 38' are connected with their ends that are averted from the coupling positions 34, 35, via an elastomere 44 that shows resilient and absorbing material-characteristics useable for pulling and pushing. FIG. 3*a* thereby portrays an in-phase and radial even position of the coupling positions 34, 35. FIG. 3*b* shows a radially even and out-of-phase position of the coupling positions 34, 35. FIG. 3*c* shows a radially uneven (R, R') and in phase position of the coupling positions 34, 35. Finally, FIG. 3*d* shows a radially uneven (R, R') and out-of-phase position of the coupling positions 34, 35, each referring to the gear-wheels that are coupled via the coupling 36', 38', 44.

Figure 4:
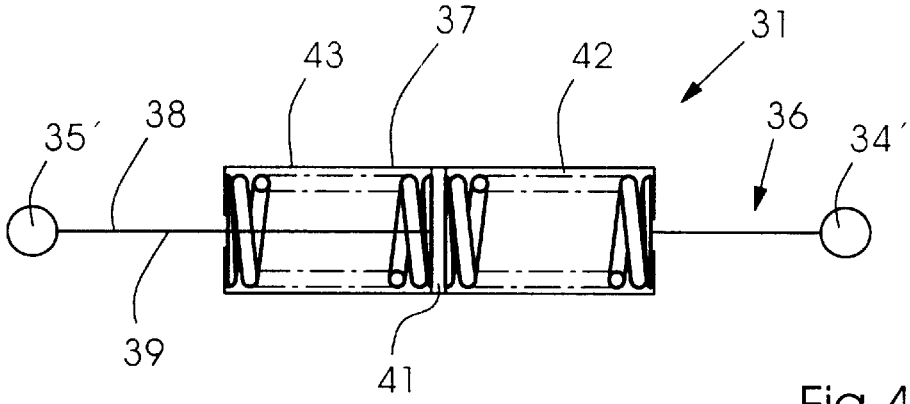
FIG. 4 an embodiment of a coupling configured according to the invention.

In the configuration of FIG. 4, a coupling-section 36 articulated at a coupling position 34 is provided with a cylindrical-housing 37, while a coupling-section 38 that is articulated at a coupling position 35 has a piston rod 39, which carries a counter-bearing in the form of an abutment-board that is guided in the cylinder 37 with its end that is averted from the coupling position 35, that is from the pivot-position 35'. The abutment-board supports on both sides of itself compression-springs 42, 43 that are touching the cylindrical-housing.

Figure 5:
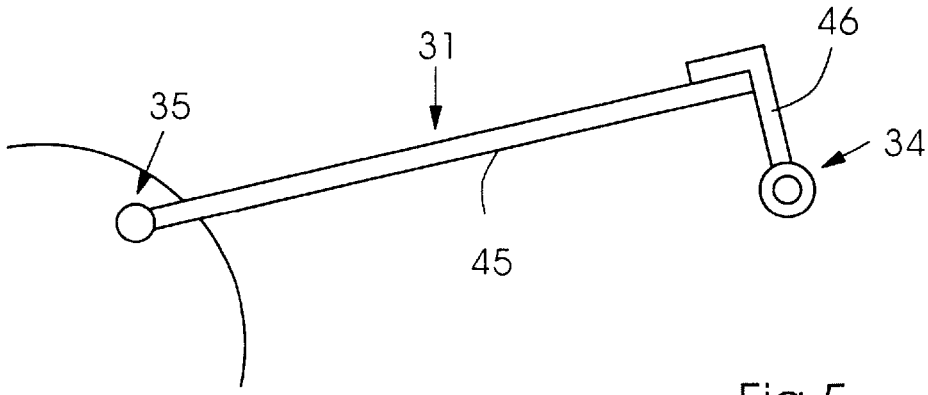
FIG. 5 a further embodiment of a coupling configured according to the invention together with a leaf spring.

In the configuration of FIG. 5 the coupling 31 has a rigid coupling rod 45, which is pivoted with one of its ends onto the coupling position 35 on the gear-wheel of a printing-cylinder, while it is connected with a leaf spring 46 on its opposite end, via which it can be pivoted at the corresponding gear-wheel of the other printing-cylinder at the coupling position 34.

Figure 6:
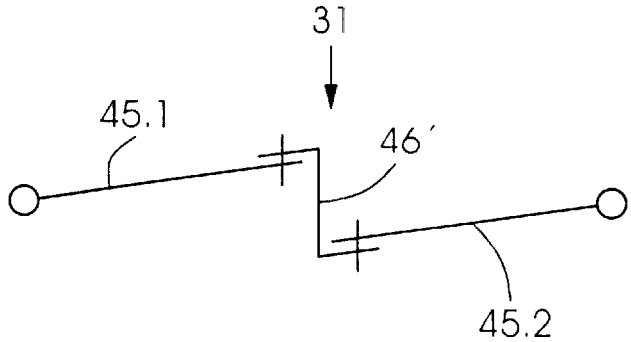
FIG. 6 a further embodiment of a coupling configured according to the invention together with a leaf spring that is arranged between two rigid coupling-sections.

In the configuration of FIG. 6 the elastic coupling has two rigid coupling-sections 45.1, 45.2 and a leaf spring 46' that connects the two.

FIGS. 7*a* to 7*d* show snapshot-positions of motions using the example of out of phase and with even radial length in reference to the gear-wheels 4' and 4" of coupling positions 34, 35. The coupling 31 is operationally periodically used to pull and push, so that the course shown qualitatively in FIG. 7*e* arises, which is transmitted from one to the other of the gear-wheels 4', 4", and which has a periodically changing torque. The greatly simplified portrayal omits structural details for reasons of clarity, such as for example a device or element that would safeguard against the bending of the coupling 31.

Figure 7A:
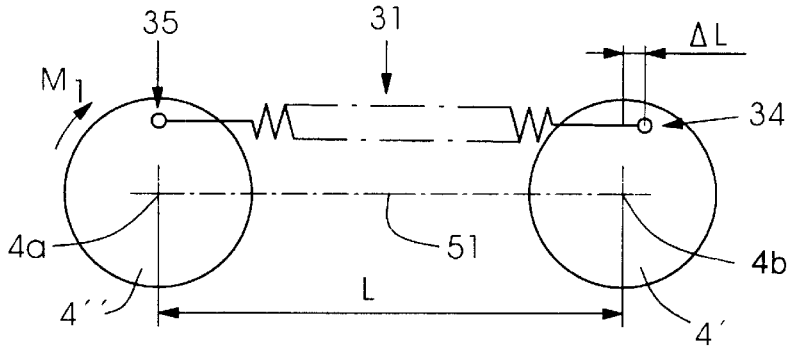
FIGS. 7*a*–7*d* are diagrammatic side views showing positions of cylinders that are interconnected with an elastic coupling according to the invention.
Figure 7B:
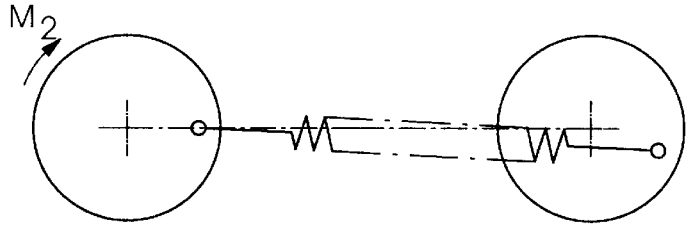
Figure 7C:
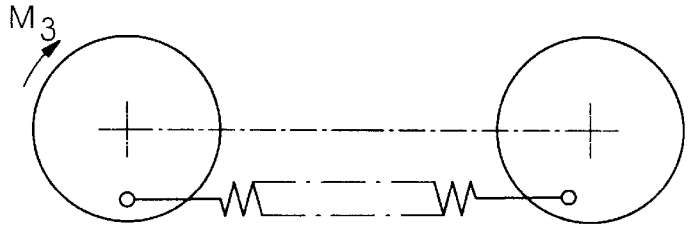
Figure 7D:
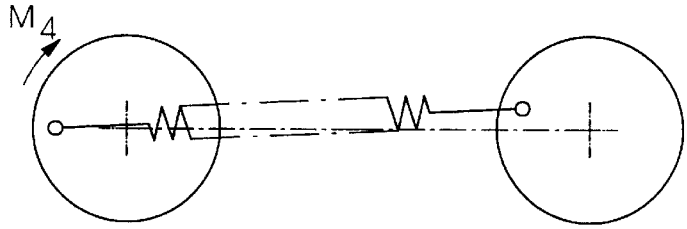
Figure 7E:
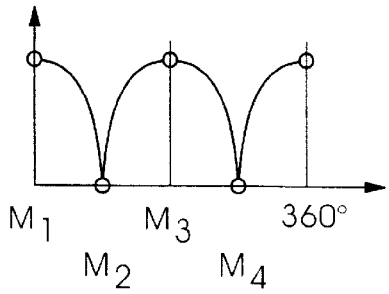
FIG. 7*e* is a resulting torque diagram pertaining to the illustrations of FIGS. 7*a*–7*d*.

The elasticity of the coupling 31 is implied by the spring 33. In a position, where the coupling 31 has a maximum distance to the connecting-line 51 between the axes 4*a* and 4*b* of the corresponding cylinders or gear-wheels, the coupling 31 is pre-stressed by a certain length $\Delta L$ (FIGS. 7*a*, 7*c*), that is with a first position (FIG. 7*a*) it is lengthened by $\Delta L$, while the coupling 31 in the second position, that is turned by 180°, of the gear-wheels 4', 4" (FIG. 7*c*) is compressed by $\Delta L$. With the other two positions, which are shifted by 90° towards the before-mentioned positions, the coupling 31 is loose (FIGS. 7*b* and 7*d*).

Because of the pivoting of the coupling 31 onto equidirectional turning gear-wheels, a periodically swelling coupling-torque ensues, which is used with a preferred configuration for the avoidance of the tooth-flank-change, which would be triggered without this coupling-torque by interference-torques. For this purpose it is to be seen to it, that—by corresponding pre-tension of the coupling—the maxima of the coupling-torque are bigger than those of the interference-torques and that in terms of the phase-position of the interference-torques in contrast to those of the coupling-torque, the latter is brought-in in that way, that a tooth-flank-change is counteracted.

For the other mentioned variants on the positions of the coupling positions 34, 35 relative to the gear-wheels, unquestionably verifiable circumstances in terms of the course of the local coupling-torque ensue. In a special case of in-phase and radially even positions of the coupling positions 34, 35, a sinusoidal course of the coupling-torque arises instead of a swelling course and the coupling, depending on its pre-tension in the pivoted condition always stands under a certain tensile stress or else a certain compressive force.

Interference-torques are not only created by the swing-gripper 11 but also at other locations of the printing press, for example by the periodic opening of the grippers of the gripper system 15. In this respect it is advantageous not to limit the configuration of the printing machine according to the invention to the fact, that in case of a majority of printing units only two consecutive ones—as illustrated—are connected via a coupling. It is understood that with multiple mountings of corresponding couplings it is to be attended to their mutual position and naturally with the respective intended purpose also to the direction of the pre-tension of the corresponding couplings.

A possible intended purpose consists of bracing the gear-wheels of a section of the gear train with a coupling-torque, which does not fall below a certain amount greater than zero.

In a preferred specific embodiment, two gearwheels of the gear train are provided with two couplings that are out of phase relative to one another.

In FIG. 2 the planned structures of assignment are portrayed schematically. The assignment of a first coupling 31 to the gear-wheels 4' and 4" is realized via a direct arrangement of the coupling positions 34 and 35 to the gear-wheels 4' and 4". The assignment of a second coupling 31 to the gear-wheels 4' and 4" is realized via a pivoting of that coupling 31 to coupling positions that are connected indirectly with the gear-wheels 4' and 4". For the purpose of this indirect pivoting, at the respective shaft-journal that is averted from the gear-wheels 4' and 4" (as mentioned, they are connected rotationally rigid with the cylinder 4) the cylinder 4 is connected in the present example to a crank 47 and 48, which respectively are connected rotationally rigidly with the corresponding shaft-journal, and the second coupling 31 is pivoted at a respective coupling position 34 and 35 of those cranks.

Thus a total torque results from the combination of the coupling-torques created by respective one of the two couplings 31, whereby the temporal course of the total-torque is susceptible, in particular, to the mutual phase positions of the two couplings. This facilitates the adjustment of the extremes of a coupling torque, which is portrayed by the total torque, in such a way that it is appearing at the same time with the extremes of the interference-torques.

A preferred configuration with two couplings that are opposite from each other and shifted out of phase, which have an effect on one-and-the-same gear-wheels, are phase-shifted by 90°. This leads to a course of the total torque that is effective as the coupling-torque, with which the torque-variations in comparison to the case of the use of only one coupling, are relatively small and the minima of the torque-variations with corresponding pre-tension of the couplings are adjustable in such a level, that the resonance-area of the printing machine can be passed through without a tooth-flank-change.

Insofar as the portrayed configurations of the couplings do work during operation—in the sense of the extension or compression of the elastic couplings—the work inevitably has an effect on the driving-torque that is impressed via the fed-in driving-power. This is in particular susceptible in that way, that by a proper choice of the phase-positions of the extrema of a corresponding coupling-torque, particularly undesirable periodical peak-values of the driving-torque can be cut back.

Figure 8:
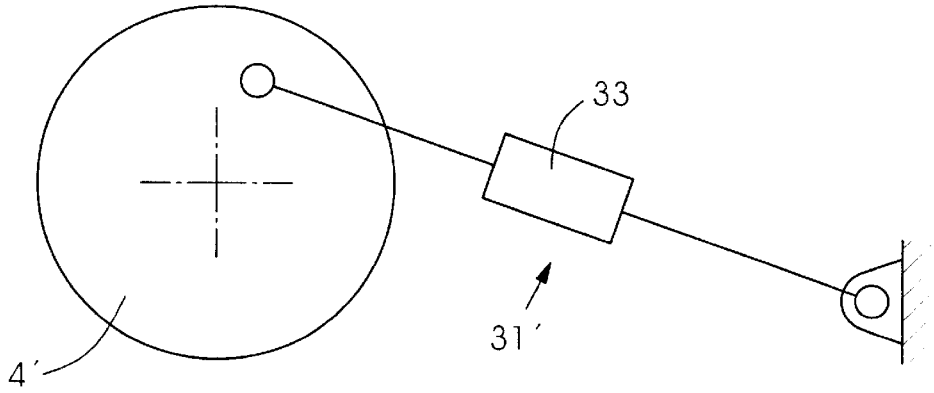
FIG. 8 is a diagrammatic side view of a crank, which is stationary, pivoted, elastic and that is assigned to the gear-wheel.

A further development of the novel configuration—which, according to the inventive concept, impresses onto a gear-wheel a periodically changing torque in addition to the driving-torque affected torque—is represented schematically in FIG. 8.

An elastic crank 31' is assigned to the gear-wheel—here exemplary to the gear-wheel 4'—in such a way, that it impresses on that a periodically changing torque.

The crank 31', corresponding to the coupling 31 of FIG. 2, is again displayed with a graphically emphasized section 33, which symbolizes the elasticity of the crank 31' that can be implemented in a variety of ways.

The assignment of the crank 31' to the gear-wheel 4' ensues depending on the configuration either by direct pivoting onto the gear-wheel 4' or by pivoting onto a coupling position that is directly connected with the gear-wheel 4'.

The crank 31' performs work in operation, so that also with this configuration a specific retroaction onto the driving-torque that has been impressed onto the gear train on the part of the driving-power, is particularly possible in that way. The effect is that undesirable peak-values of the driving-torque are cut back.

We claim:

1. A printing machine, comprising:

a plurality of rollers;

a gear train formed with a plurality of mutually meshing gear-wheels connected to and driving said rollers;

at least one first hinge operatively connected to a first one of said gear-wheels;

at least one second hinge operatively connected to a second one of said gear-wheels; and at least one elastic connector articulated at said first hinge and said second hinge;

said first one and said second one of said gear-wheels rotating equidirectionally;

said first hinge and said second hinge being disposed eccentrically with respect to a respective rotary axis of said first one and said second one of said gear-wheels;

said elastic connector transferring a periodically changing torque from said first one to said second one of said gear-wheels via said first hinge and said second hinge.

2. The printing machine according to claim 1, wherein said hinges are disposed in phase and at radially even positions.

3. The printing machine according to claim 1, wherein said hinges are disposed out of phase and at radially even positions.

4. The printing machine according to claim 1, wherein said hinges are disposed in phase and at radially uneven positions.

5. The printing machine according to claim 1, wherein said hinges are disposed out of phase and at radially uneven positions.

6. The printing machine according to claim 1, wherein said elastic connector is configured resilient and absorbing.

7. The printing machine according to claim 1, wherein said elastic connector includes an elastomer part.

8. The printing machine according to claim 1, wherein said elastic connector includes a resilient and absorbing polymer.

9. The printing machine according to claim 1, wherein said elastic connector includes a spring.

10. The printing machine according to claim 1, wherein said elastic connector includes a cylindrical housing and a coupling rod having an abutment-board guided within said cylindrical housing, and springs disposed between said cylindrical housing and said abutment-board.

11. The printing machine according to claim 1, wherein said elastic connector includes a rigid rod and a leaf spring connected to said rigid rod.

12. The printing machine according to claim 1, wherein said elastic connector has two rods connected by a leaf spring.

13. The printing machine according to claim 1, wherein said gear train interconnects a plurality of processing stations of a sheet-fed printing machine.

14. The printing machine according to claim 1, including a further elastic connector acting between said first and said second one of said gear-wheels to operationally transfer a periodically changing torque from said first one to said second one of said gear-wheels;

said elastic connector and said further elastic connector being disposed at opposite sides of the printing machine.

15. The printing machine according to claim 14, wherein said elastic connector and said further elastic connector are disposed out of phase relative to one another.

16. A printing machine, comprising:

at least one processing station including cylinders and drums;

at least one gear train formed with a plurality of mutually intermeshing gear-wheels connected to and driving said cylinders and drums; and a first hinge operatively connected to one of said gear-wheels and disposed eccentrically with respect to a rotary axis of said one of said gear-wheels;

a stationary second hinge; and an elastic connector articulated at said first hinge and said second hinge.

17. The printing machine according to claim 16, wherein said processing station forms a part of a sheet-fed printing machine.

* * * * *